US011330923B2

(12) United States Patent
Cardinal

(10) Patent No.: US 11,330,923 B2
(45) Date of Patent: May 17, 2022

(54) COLLAPSIBLE AND LOCKING CLOTHES HANGER

(71) Applicant: Justin Cardinal, Morrisburg (CA)

(72) Inventor: Justin Cardinal, Morrisburg (CA)

( * ) Notice: Subject to any disclaimer, the term of this patent is extended or adjusted under 35 U.S.C. 154(b) by 0 days.

(21) Appl. No.: 17/154,260

(22) Filed: Jan. 21, 2021

(65) Prior Publication Data

US 2021/0244220 A1 Aug. 12, 2021

(51) Int. Cl.
*A47G 25/40* (2006.01)
*A47G 25/32* (2006.01)

(52) U.S. Cl.
CPC ..... *A47G 25/4023* (2013.01); *A47G 25/32* (2013.01); *A47G 25/4053* (2013.01); *A47G 2025/4092* (2013.01)

(58) Field of Classification Search
CPC .... A47G 25/40; A47G 25/4023; A47G 25/32; A47G 25/4053; A47G 25/403; A47G 25/4015; A47G 25/4016; A47G 25/4061; A47G 25/4069; A47G 25/44; A47G 25/443; A47G 2025/4092
USPC ..... D6/315, 318
See application file for complete search history.

(56) References Cited

U.S. PATENT DOCUMENTS 2,586,913 A * 2/1952 Burns ..... A47G 25/4023 D6/318
2,872,090 A * 2/1959 Goodman ..... A47G 25/4023 D6/318
3,487,984 A * 1/1970 Loscalzo ..... A47G 25/487 223/96
3,531,028 A * 9/1970 Vazquez ..... A47G 25/4023 D6/318
4,948,019 A * 8/1990 Rodum ..... A47G 25/4023 223/89
5,901,888 A * 5/1999 Schneider ..... A47G 25/403 223/89
6,427,882 B1 8/2002 Harvey
7,036,696 B2 5/2006 Lam
8,186,547 B2 * 5/2012 Morawietz ..... A47G 25/442 223/94
9,247,838 B2 * 2/2016 Kallet ..... A47G 25/4023

FOREIGN PATENT DOCUMENTS

WO WO 2007054749 A1 * 5/2007

* cited by examiner

*Primary Examiner* — Ismael Izaguirre
(74) *Attorney, Agent, or Firm* — The Dobrusin Law Firm, P.C.; Bryan S. Lemanski

(57) ABSTRACT

The present disclosure provides a collapsible and locking clothes hanger for one-handed individuals. In at least one embodiment, a collapsible clothes hanger comprises a central hook portion including a hook element and a helical torsion spring, a first hanger arm and a second hanger arm, the helical torsion spring adapted to bias the first and the second hanger arms into an expanded position, each of the first and the second hanger arms moveable to a collapsed position, with the first hanger arm including a sliding component moveable between a first position and a second position, the sliding component including a first catch, the second hanger arm including a second catch, the first catch securely engaging the second catch in the first position, the first catch disengaging the second catch in the second position to move the first and the second hanger arms from the collapsed position to the expanded position.

12 Claims, 8 Drawing Sheets

COLLAPSIBLE AND LOCKING CLOTHES HANGER

FIELD

The present disclosure relates to clothes hangers. More specifically, the present disclosure relates to collapsible and locking clothes hangers.

BACKGROUND

Clothes hangers are used to hang various types of clothing, including dress shirts, blouses, sweaters, jackets, and dresses, among others. They are typically constructed of a piece of material that is rigid and inflexible, which can make it challenging to hang certain styles of clothing, such as clothing with small openings for the neck. Most people hang clothing using one hand to hold and stabilize the hanger, with the other hand manipulating the clothing to insert or remove the hanger. For individuals who are one-handed, completing this task is much more challenging as it is difficult to both adjust the clothing and stabilize the hanger using one hand.

Current clothes hangers are therefore not adapted to enable one-handed individuals to hang their clothes efficiently. While some foldable clothes hangers exist, none of them allow these individuals to insert and remove the hangers from clothing with one hand with very little effort.

For example, U.S. Pat. No. 6,427,882 describes a clothes hanger that enables users to hang small-necked garments. The hanger has a spring element that extends along the underside of two pivoting arms of the hanger, which projects outwardly when the hanger is in an expanded position. When a downward force is applied to the two pivoting arms by the user, the pivoting arms rotate toward one another to reach a collapsed position. When the user releases the pivoting arms, the spring element forces the pivoting arms to return to the expanded position. However, the configuration of this hanger is inefficient, as the user is required to continuously apply force to maintain the hanger in the collapsed position while inserting or removing the hanger. This requirement may be problematic for users who do not have the strength to hold the pivoting arms in the collapsed position with one hand for a prolonged period of time. Further, it would be very difficult for one-handed individuals to make any adjustments to the clothing without releasing the hanger as the hanger is being inserted or removed, since one hand is needed to hold the pivoting arms together.

U.S. Pat. No. 7,036,696 also describes a foldable clothes hanger with two arms that a user can fold down into a collapsed position so that the hanger can be inserted into the neck of a piece of clothing. When the user releases the two arms, a spring element brings the arms back up into an expanded position. The drawbacks of this arrangement are similar to U.S. Pat. No. 6,427,882, as the user is again required to expend unnecessary effort to keep the arms in the collapsed position while hanging the clothing. U.S. Pat. No. 7,036,696 further describes a lock-release mechanism that locks the arms into the expanded position so that the arms cannot rotate toward one another. This lock-release mechanism does not provide a solution to the problems faced by one-handed individuals, as locking the hanger in the expanded position does not facilitate the one-handed insertion and removal of the hanger from a piece of clothing.

Accordingly, there is a need for a collapsible clothes hanger that can lock in a collapsed position so that a one-handed individual can easily and efficiently insert and remove the hanger from clothing.

BRIEF SUMMARY

It is contemplated that the present disclosure provides a collapsible clothes hanger with a locking mechanism that locks two arms of the hanger in a collapsed position, enabling individuals to efficiently insert and remove the hanger from clothing with one hand.

In at least one embodiment it is contemplated that the present disclosure provides a collapsible clothes hanger comprising a central hook portion, the central hook portion including a hook element adapted for receiving a closet rod, and a helical torsion spring, the helical torsion spring pivotally connected to the central hook portion about a transverse pivoting axis, a first outwardly projecting hanger arm extending longitudinally between a distal end and a proximal end, a second outwardly projecting hanger arm extending longitudinally between a distal end and a proximal end, the proximal end of the first outwardly projecting hanger arm and the proximal end of the second outwardly projecting hanger arm each pivotally connected to the central hook portion about the transverse pivoting axis, the helical torsion spring adapted to bias the first outwardly projecting hanger arm and the second outwardly projecting hanger arm into a first expanded position, the first outwardly projecting hanger arm generally horizontally opposed from the second outwardly projecting hanger arm in the first expanded position, each of the first outwardly projecting hanger arm and the second outwardly projecting hanger arm moveable to a second collapsed position, the first outwardly projecting hanger arm and the second outwardly projecting hanger arm oriented in a generally vertical and opposed manner in the second collapsed position, such that the first outwardly projecting hanger arm includes a sliding component located between the proximal end and the distal end of the first outwardly projecting hanger arm, the sliding component longitudinally moveable between a first position and a second position, the sliding component including a downwardly projecting first catch, the sliding component biased into the first position by a spring, the second outwardly projecting hanger arm including a downwardly projecting second catch, the downwardly projecting first catch securely engaging the downwardly projecting second catch when the sliding component is in the first position, the downwardly projecting first catch disengaging the downwardly projecting second catch when the sliding component is in the second position, and the first outwardly projecting hanger arm and the second outwardly projecting hanger arm moving from the second collapsed position to the first expanded position when the downwardly projecting first catch is disengaged from the downwardly projecting second catch.

DESCRIPTION OF THE FIGURES

The present disclosure will be better understood in connection with the following FIGURES, in which.

DETAILED DESCRIPTION OF THE EMBODIMENTS

It is contemplated that the present disclosure provides a collapsible clothes hanger that locks into a collapsed position to facilitate the insertion and removal of the hanger from clothing using one hand.

It is contemplated that the components of the presently disclosed hanger can be manufactured to any suitable dimensions using any suitable materials and by way of any suitable manufacturing technique, as will be readily appreciated by the skilled person.

In the context of the present disclosure, a "generally horizontal" element does not have to be perfectly horizontal, but may be angled or curved while still extending in a generally horizontal direction.

In the context of the present disclosure, a "generally vertical" element does not have to be perfectly vertical, but may be angled or curved while still extending in a generally vertical direction.

Figure 1:
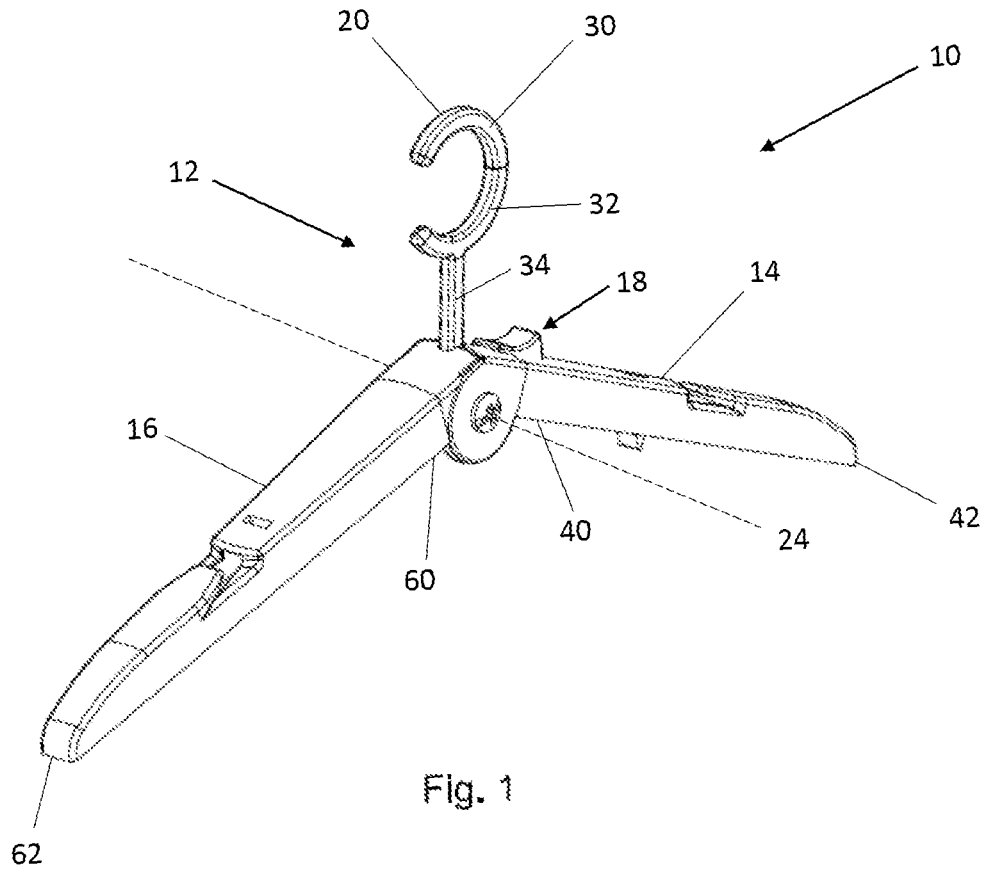
FIG. 1 is a perspective view of a collapsible clothes hanger in a first expanded position in accordance with at least one embodiment of the present invention.

Turning to FIG. 1, at least one embodiment of a collapsible clothes hanger in accordance with the present invention is illustrated. In this embodiment, collapsible clothes hanger 10 includes a central hook portion 12, a first outwardly projecting hanger arm 14, and a second outwardly projecting hanger arm 16. The first outwardly projecting hanger arm 14 and the second outwardly projecting hanger arm 16 are shown in a first expanded position.

The central hook portion 12 includes a hook element 20 and a helical torsion spring (not shown). The hook element 20 has an upper concave element 30 and a lower concave element 32 that are adapted to receive a closet rod in between the upper concave element 30 and the lower concave element 32, with the lower concave element 32 connected to an upwardly projecting vertical element 34. It is contemplated that the configuration of the upper concave element 30 and the lower concave element 32 allows the hook element 20 to wrap securely around the closet rod to prevent the collapsible clothes hanger 10 from falling off when jostled.

The first outwardly projecting hanger arm 14 extends longitudinally between a proximal end 40 and a distal end 42. Similarly, the second outwardly projecting hanger arm 16 extends longitudinally between a proximal end 60 and a distal end 62. In the first expanded position, the first outwardly projecting hanger arm 14 is generally horizontally opposed from the second outwardly projecting hanger arm 16. The first outwardly projecting hanger arm 14 includes a locking mechanism 18 located between the proximal end 40 and the distal end 42 of the first outwardly projecting hanger arm 14. The proximal end 40 of the first outwardly projecting hanger arm 14 and the proximal end 60 of the second outwardly projecting hanger arm 16 each pivotally connect to the central hook portion 12 about a transverse pivoting axis 24. A transverse axle which can comprise a bushing and cooperating mechanical fasteners (not shown) is provided at the transverse pivoting axis 24, which will be discussed in further detail herein.

Figure 2:
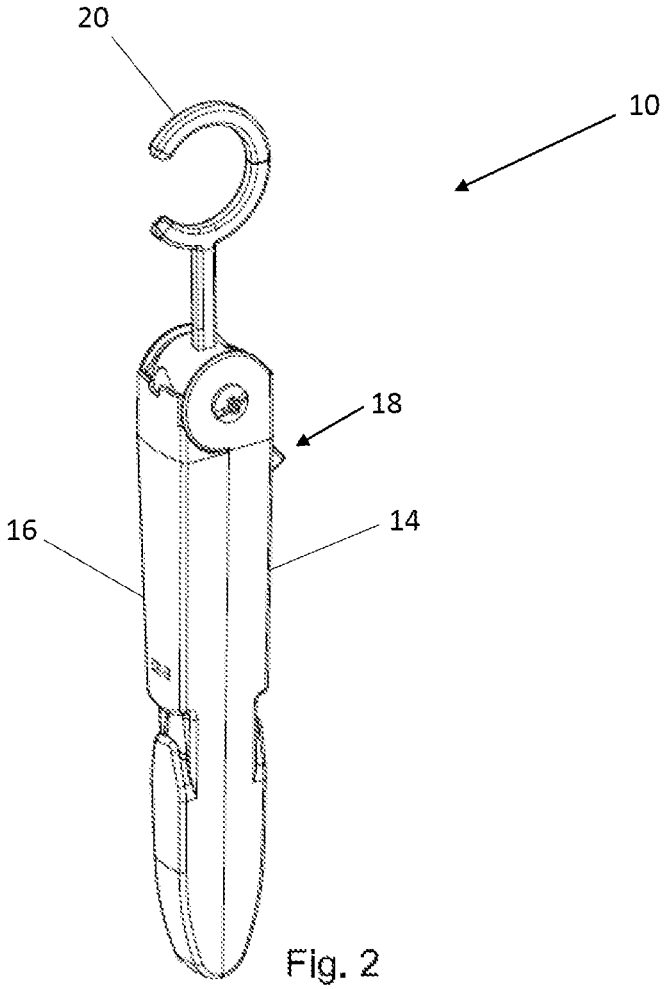
FIG. 2 is a perspective view of the collapsible clothes hanger of FIG. 1 in a second collapsed position.

FIG. 2 illustrates at least one embodiment of the collapsible clothes hanger 10 in a second collapsed position. In the second collapsed position, it is contemplated that the first outwardly projecting hanger arm 14 and the second outwardly projecting hanger arm 16 are oriented in a generally vertical and opposed manner, forming a smoothly continuous shape with a rounded lower end that allows the collapsible clothes hanger 10 to slide smoothly into and out of a piece of clothing.

Figure 3:
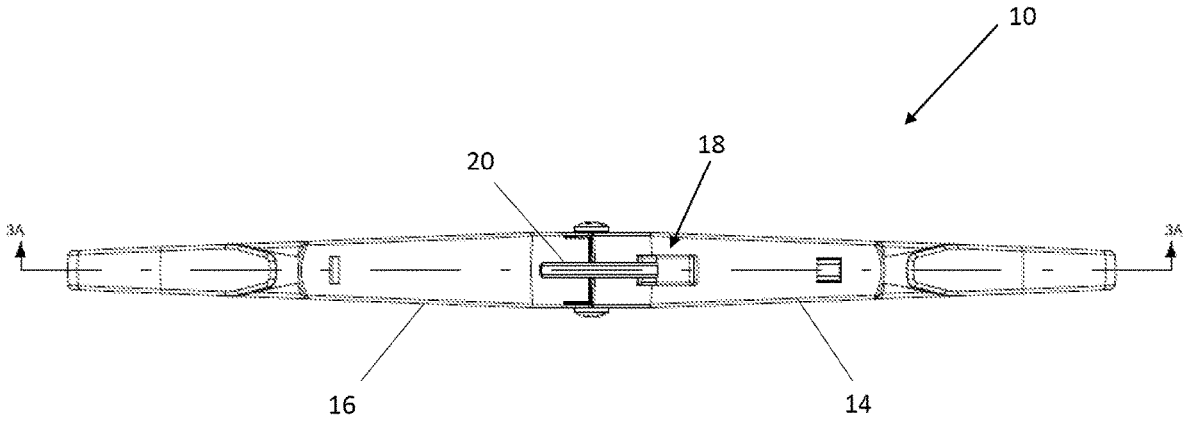
FIG. 3 is a top perspective view of the collapsible clothes hanger of FIG. 1 in the first expanded position.

FIG. 3 is a top perspective view of the collapsible clothes hanger 10 with the first outwardly projecting hanger arm 14 and the second outwardly projecting hanger arm 16 in the first expanded position.

Figure 3A:
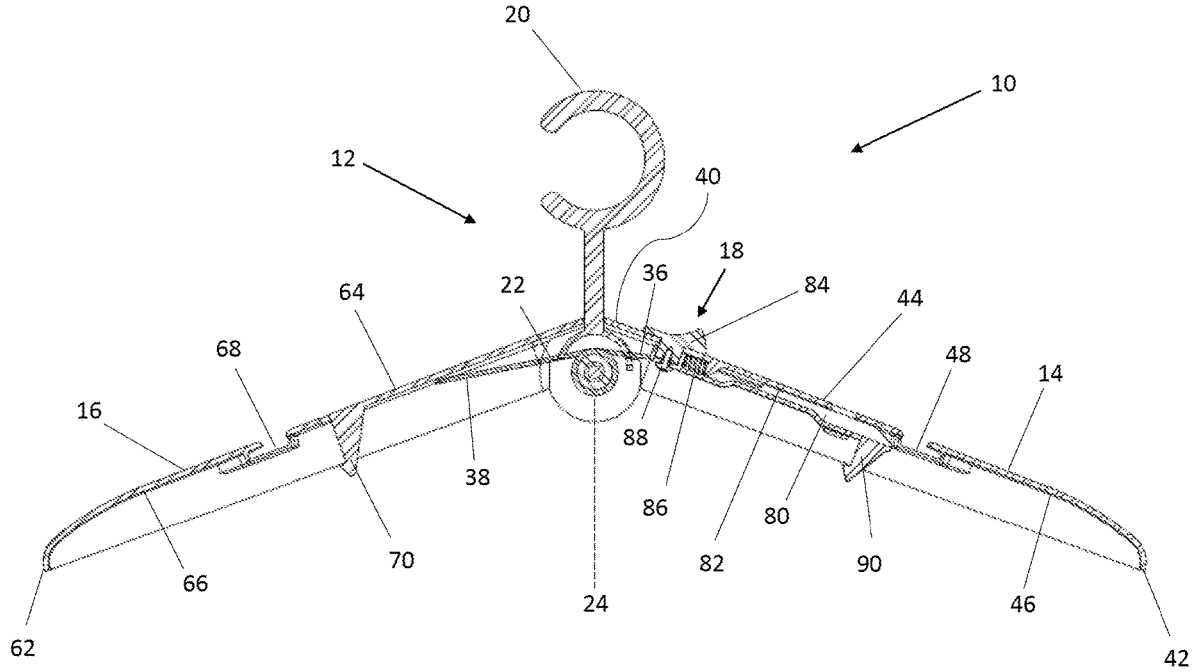
FIG. 3A is a cross-sectional view of the collapsible clothes hanger of FIG. 3.

In FIG. 3A, a cross-sectional view of at least one embodiment of the collapsible clothes hanger 10 is shown in the first expanded position. It is contemplated that at least one of the first outwardly projecting hanger arm 14 and the second outwardly projecting hanger arm 16 can have a first side, a second side, and an upper surface. In this particular embodiment, the first outwardly projecting hanger arm 14 and the second outwardly projecting hanger arm 16 each have an upper surface 44, 64 that include indentations 48, 68 for securing clothing that have, for example, strings or straps.

In at least one embodiment, it is contemplated that the helical torsion spring 22 is pivotally connected to the central hook portion 12 about a transverse pivoting axis 24. The helical torsion spring 22 is adapted to bias the first outwardly projecting hanger arm 14 and the second outwardly projecting hanger arm 16 into the first expanded position. The helical torsion spring 22 has an outwardly projecting first arm 36 and an outwardly projecting second arm 38, with the outwardly projecting first am 36 engaging an opposed lower surface 46 of the upper surface 44 of the first outwardly projecting hanger arm 14 and the outwardly projecting second arm 38 engaging an opposed lower surface 66 of the upper surface 64 of the second outwardly projecting hanger arm 16.

In at least one embodiment, it is contemplated that the locking mechanism 18 comprises a sliding component 80 located between the proximal end 40 and the distal end 42 of the first outwardly projecting hanger arm 14. The sliding component 80 is slidably received in a channel 82 oriented longitudinally on the first outwardly projecting hanger arm 14. In at least one embodiment, it is contemplated that channel 82 is located on the opposed lower surface 46 of the upper surface 44 of the first outwardly projecting hanger arm 14. The sliding component 80 includes an upwardly projecting tab component 84 operable to move the sliding component 80 longitudinally from a first position to a second position, with the sliding component biased into the first position by a spring 86. It is contemplated that the upwardly projecting tab component 84 can project upwardly through a slot provided in the upper surface 44 of the first outwardly projecting hanger arm 14. The upwardly projecting tab component 84 is attached to the sliding component 80 by any suitable means, including, but not limited to, mechanical fasteners such as a screw 88. The sliding component 80 further includes a downwardly projecting first catch 90. A downwardly projecting second catch 70 projects downwardly from the opposed lower surface 66 of the upper surface 64 of the second outwardly projecting hanger arm 16.

Figure 4:
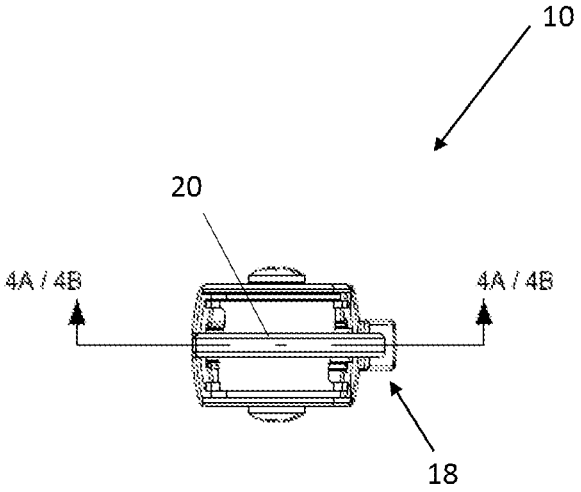
FIG. 4 is a top perspective view of the collapsible clothes hanger of FIG. 1 in the second collapsed position.

FIG. 4 is a top perspective view of the collapsible clothes hanger 10, with the first outwardly projecting hanger arm 14 and the second outwardly projecting hanger arm 16 in the second collapsed position.

Figure 4A:
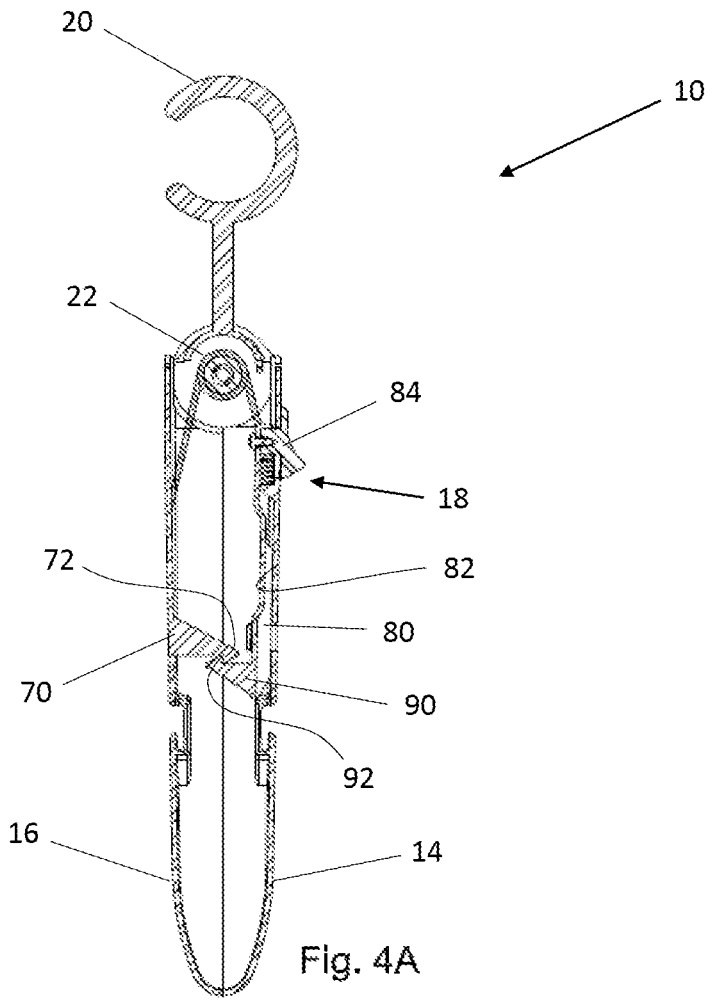
FIG. 4A is a cross-sectional view of the collapsible clothes hanger of FIG. 4, where a downwardly projecting first catch securely engages a downwardly projecting second catch.

In FIG. 4A, a cross-sectional view of at least one embodiment of the collapsible clothes hanger 10 is shown in the second collapsed position. When the sliding component 80 is in the first position, the downwardly projecting first catch 90 securely engages the downwardly projecting second catch 70 to lock the first outwardly projecting hanger arm 14 and the second outwardly projecting hanger arm 16 in the second collapsed position. Each of the downwardly projecting first catch 90 and the downwardly projecting second catch 70 further comprise a horizontal edge 92, 72 so that the horizontal edge 92 of the downwardly projecting first catch 90 engages the horizontal edge 72 of the downwardly projecting second catch 70 when the sliding component 80 is in the second collapsed position.

Figure 4B:
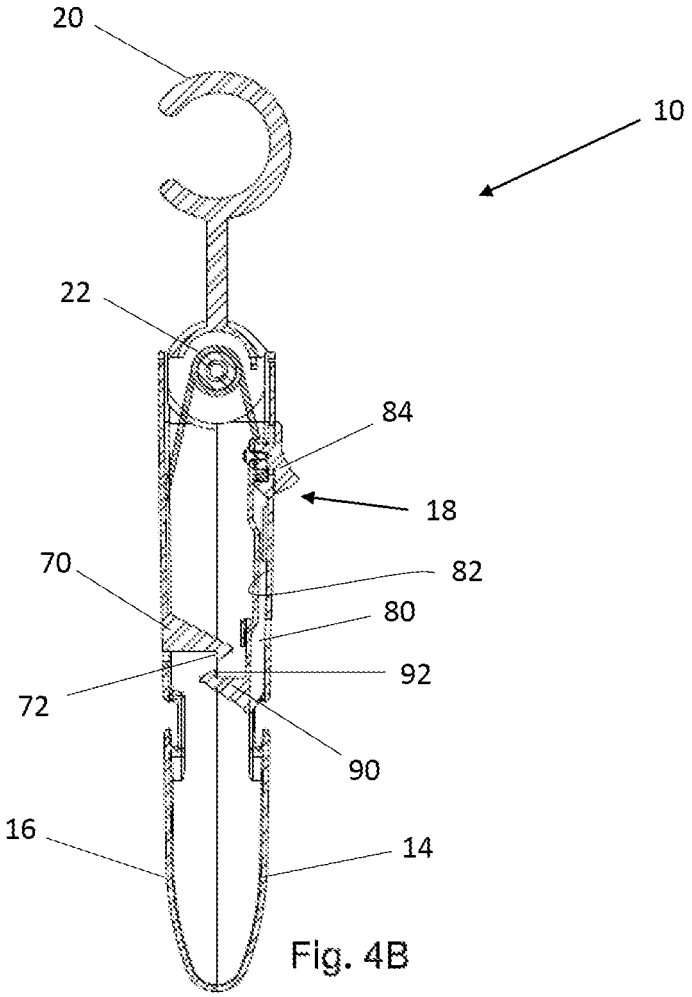
FIG. 4B is a cross-sectional view of the collapsible clothes hanger of FIG. 4, where the downwardly projecting first catch disengages from the downwardly projecting second catch.

In FIG. 4B, a cross-sectional view of at least one embodiment of the collapsible clothes hanger 10 is illustrated in the second collapsed position, with the sliding component 80 in the second position. When the sliding component 80 is in the second position, the downwardly projecting first catch 90 disengages the downwardly projecting second catch 70, allowing the first outwardly projecting hanger arm 14 and the second outwardly projecting hanger arm 16 to move from the second collapsed position to the first expanded position.

Figure 5:
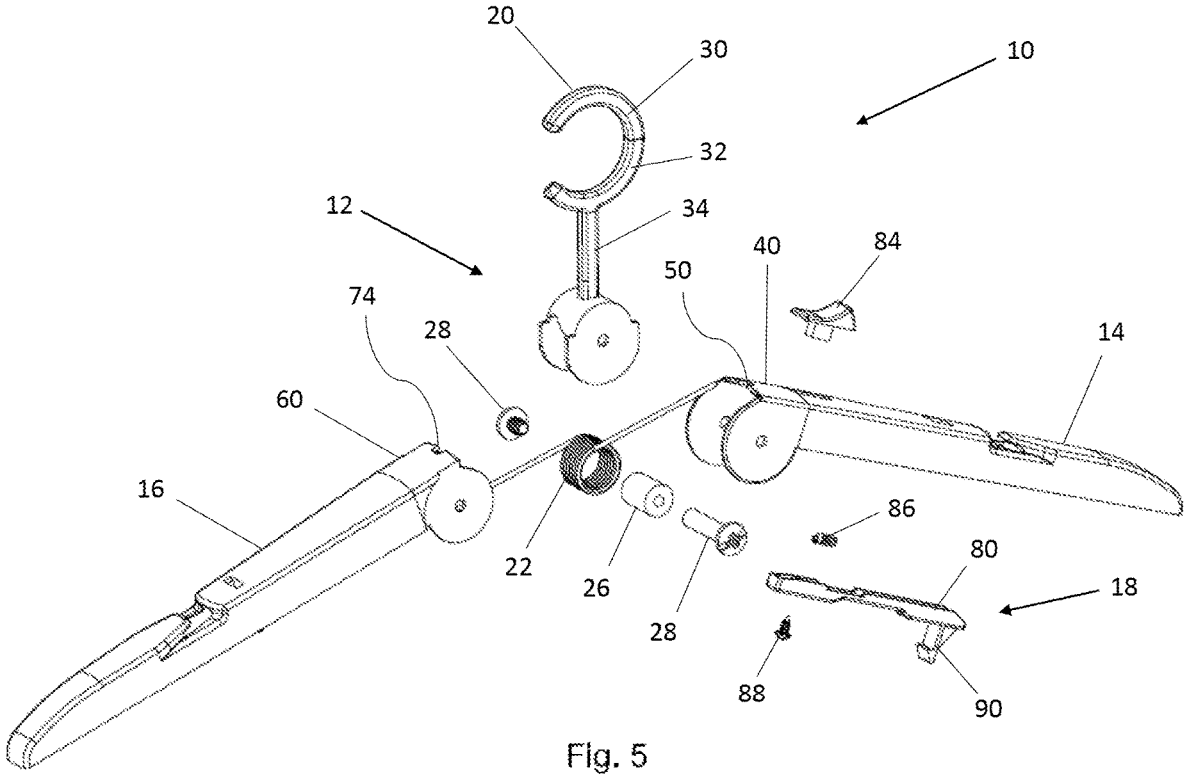
FIG. 5 an exploded perspective view of the collapsible clothes hanger of FIG. 1.

Turning to FIG. 5, an exploded perspective view of the collapsible clothes hanger 10 is illustrated. The central hook portion 12, including the hook element 20 and the helical torsion spring 22, the first outwardly projecting hanger arm 14, and the second outwardly projecting hanger arm 16 are pivotably connected at the transverse axle, which comprises a bushing 26 that extends through the helical torsion spring 22 and mechanical fasteners 28 that attach to a first and a second end of the bushing 26. The first outwardly projecting hanger arm 14 and the second outwardly projecting hanger arm 16 pivot around the transverse axle to move between the first expanded position and the second collapsed position.

When the collapsible clothes hanger 10 is in the first expanded position, it is contemplated that an upper edge 50 of the proximal end 40 of the first outwardly projecting hanger arm 14 and an upper edge 74 of the proximal end 60 of the second outwardly projecting hanger arm 16 each abut the upwardly projecting vertical element 34 of the central hook portion 12 so that the first outwardly projecting hanger arm 14 and the second outwardly projecting hanger arm 16 do not extend past the first expanded position as the first outwardly projecting hanger arm 14 and the second outwardly projecting hanger arm 16 move back from the second collapsed position.

The embodiments described herein are intended to be illustrative of the present compositions and are not intended to limit the scope of the present disclosure. Various modifications and changes consistent with the description as a whole and which are readily apparent to the person of skill in the art are intended to be included. The appended claims should not be limited by the specific embodiments set forth in the examples but should be given the broadest interpretation consistent with the description as a whole.

What is claimed is:

1. A collapsible clothes hanger comprising:

a central hook portion, the central hook portion including a hook element adapted for receiving a closet rod, and a helical torsion spring, the helical torsion spring pivotally connected to the central hook portion about a transverse pivoting axis;

a first outwardly projecting hanger arm extending longitudinally between a distal end and a proximal end;

a second outwardly projecting hanger arm extending longitudinally between a distal end and a proximal end, the proximal end of the first outwardly projecting hanger arm and the proximal end of the second outwardly projecting hanger arm each pivotally connected to the central hook portion about the transverse pivoting axis; the helical torsion spring adapted to bias the first outwardly projecting hanger arm and the second outwardly projecting hanger arm into a first expanded position, the first outwardly projecting hanger arm generally horizontally opposed from the second outwardly projecting hanger arm in the first expanded position, each of the first outwardly projecting hanger arm and the second outwardly projecting hanger arm moveable to a second collapsed position, the first outwardly projecting hanger arm and the second outwardly projecting hanger arm oriented in a generally vertical and opposed manner in the second collapsed position;

wherein the first outwardly projecting hanger arm includes a sliding component located between the proximal end and the distal end of the first outwardly projecting hanger arm, the sliding component longitudinally moveable between a first position and a second position, the sliding component including a downwardly projecting first catch, the sliding component biased into the first position by a spring;

the second outwardly projecting hanger arm including a downwardly projecting second catch, the downwardly projecting first catch securely engaging the downwardly projecting second catch when the sliding component is in the first position, the downwardly projecting first catch disengaging the downwardly projecting second catch when the sliding component is in the second position; and the first outwardly projecting hanger arm and the second outwardly projecting hanger arm moving from the second collapsed position to the first expanded position when the downwardly projecting first catch is disengaged from the downwardly projecting second catch.

2. The collapsible clothes hanger of claim 1, wherein a transverse axle is provided at the transverse pivoting axis, the transverse axle pivotably connecting the central hook portion, the first outwardly projecting hanger arm and the second outwardly projecting hanger arm.

3. The collapsible clothes hanger of claim 1, wherein the sliding component is slidably received in a channel, the channel oriented longitudinally in the first outwardly projecting hanger arm.

4. The collapsible clothes hanger of claim 1, wherein the hook element has an upper concave element and a lower concave element, the upper concave element opposed from the lower concave element, the closet rod received between the upper concave element and the lower concave element.

5. The collapsible clothes hanger of claim 1, wherein at least one of the first outwardly projecting hanger arm and the second outwardly projecting hanger arm has a first side, a second side, and an upper surface.

6. The collapsible clothes hanger of claim 1, wherein the helical torsion spring has an outwardly projecting first arm and an outwardly projecting second arm, the outwardly projecting first arm of the helical torsion spring engaging an opposed lower surface of the upper surface of the first outwardly projecting hanger arm, the outwardly projecting second arm of the helical torsion spring engaging an opposed lower surface of the upper surface of the second outwardly projecting hanger arm.

7. The collapsible clothes hanger of claim 1, wherein the downwardly projecting second catch of the second outwardly projecting hanger arm projects downwardly from an opposed lower surface of the upper surface of the second outwardly projecting hanger arm.

8. The collapsible clothes hanger of claim 1, wherein the first outwardly projecting hanger arm and the second outwardly projecting hanger arm form a smoothly continuous shape in the second collapsed position.

9. The collapsible clothes hanger of claim 1, wherein the upper surface of at least one of the first outwardly projecting hanger arm and the second outwardly projecting hanger arm include indentations.

10. The collapsible clothes hanger of claim 1, wherein the downwardly projecting first catch and the downwardly projecting second catch each further comprise a horizontal edge, the horizontal edge of downwardly projecting first catch engaging the horizontal edge of the downwardly projecting second catch when the sliding component is in the first position.

11. The collapsible clothes hanger of claim 1, wherein the sliding component further comprises an upwardly projecting tab component, the upwardly projecting tab component operable to move the sliding component from the first position to the second position.

12. The collapsible clothes hanger of claim 1, wherein an upper edge of the proximal end of the first outwardly projecting hanger arm and an upper edge of the proximal end of the second outwardly projecting hanger arm each abut the central hook portion in the first expanded position.

* * * * *